US012196073B2

(12) United States Patent
Kalu-Ulu et al.

(10) Patent No.: US 12,196,073 B2
(45) Date of Patent: Jan. 14, 2025

(54) ELECTRICAL SUBMERSIBLE PUMP (ESP) LANDING TEST PROBE PROTECTION DESIGN

(71) Applicant: SAUDI ARABIAN OIL COMPANY, Dhahran (SA)

(72) Inventors: Torty C. Kalu-Ulu, Dhahran (SA); James O. Arukhe, Dhahran (SA); Mohammed H. Aleid, Al Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 131 days.

(21) Appl. No.: 17/809,139

(22) Filed: Jun. 27, 2022

(65) Prior Publication Data

US 2023/0417137 A1 Dec. 28, 2023

(51) Int. Cl.
*E21B 47/017* (2012.01)
*E21B 47/008* (2012.01)

(52) U.S. Cl.
CPC ..... *E21B 47/017* (2020.05); *E21B 47/008* (2020.05)

(58) Field of Classification Search
CPC ..... E21B 4/017; E21B 17/028; E21B 17/023
See application file for complete search history.

(56) References Cited

U.S. PATENT DOCUMENTS 4,874,327 A * 10/1989 Ip ..... E21B 17/028 439/275
7,208,855 B1 * 4/2007 Floyd ..... G02B 6/4427 385/98
10,151,194 B2 12/2018 Roth et al.
2008/0230232 A1 * 9/2008 Farrara ..... E21B 33/0407 166/65.1
2009/0178803 A1 * 7/2009 Neuroth ..... F04D 13/10 166/62

OTHER PUBLICATIONS

Roth, B.A., et al., "Novel Electric Submersible Pump Cable Operates in High H2S Production Environment", SPE-188737-MS, Society of Petroleum Engineers, Nov. 2017, pp. 1-16 (16 pages).

* cited by examiner

*Primary Examiner* — Giovanna Wright
(74) *Attorney, Agent, or Firm* — Osha Bergman Watanabe & Burton LLP

(57) ABSTRACT

A system and method for a probe protector in a well includes a cable disposed within the well; a probe installed on an end of the cable; and a probe protector mounted on the cable conductor. The probe includes at least one lead and a cable conductor disposed on a distal end of each of the at least one lead. The probe protector is removably connected over the cable conductor. The probe protector is removed from the cable conductor prior to insertion of the cable into the well.

17 Claims, 3 Drawing Sheets

ELECTRICAL SUBMERSIBLE PUMP (ESP) LANDING TEST PROBE PROTECTION DESIGN

BACKGROUND

Hydrocarbon fluids are often found in hydrocarbon reservoirs located in porous rock formations far below the Earth's surface. Wells may be drilled to extract the hydrocarbon fluids from the hydrocarbon reservoirs. Most wells have a variation of downhole equipment, such as Electrical Submersible Pump (ESP) systems, installed to help with production of hydrocarbons. Many ESP systems require installation landing test probes where the probe is disposed on the cable and is exposed to the environment. This requires a probe protector to be used to decelerate the aging of the probes. The probe is a weak point in the ESP completion where there is uncertainty of electrical integrity experienced during rig work. During transportation, handling on the rig floor, and in normal service, the cable conductor on the probe becomes contaminated from debris. Inadequate protection of the probe may cause low electrical readings and warrant frequent pulls due to the low integrity. Low electrical readings may also warrant removal of the blow-out preventer (BOP) in order to check or test the connections. Therefore, there is a need for an adequate probe protector to maintain the integrity of the probe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for a probe protector in a well, the system comprising: a cable disposed within the well; a probe installed on an end of the cable, wherein the probe comprises at least one lead and a cable conductor disposed on a distal end of each of the at least one lead; and a probe protector mounted on the cable conductor, wherein the probe protector is removably connected over the cable conductor, and wherein the probe protector is removed from the cable conductor prior to insertion of the cable into the well.

In one aspect, embodiments disclosed herein relate to a probe protector method, the method comprising: attaching the probe protector to a cable, the cable comprising a probe, at least one lead, a cable conductor, and the probe protector, wherein the probe protector covers the cable conductor on each of the at least one lead at a distal end of the probe; removing the probe protector prior to running the cable to a predetermined depth in a well.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
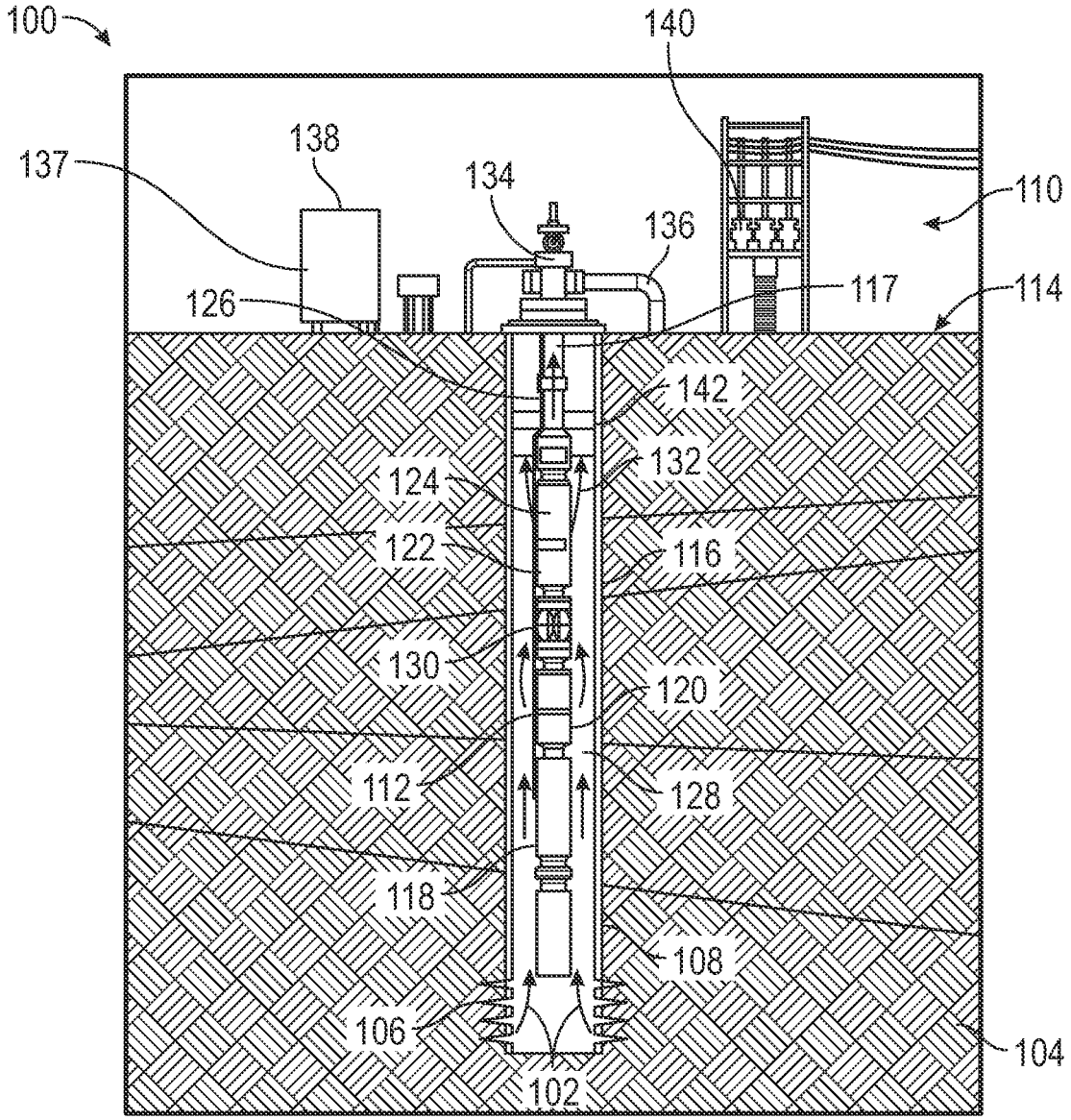
FIG. 1 shows an exemplary electrical submersible pump (ESP) system in accordance with one or more embodiments.

FIG. 1 shows an exemplary ESP system (100) in accordance with one or more embodiments. The ESP system (100) is used to help produce produced fluids (102) from a formation (104). Perforations (106) in the well's (116) casing (108) provide a conduit for the produced fluids (102) to enter the well (116) from the formation (104). The ESP system (100) includes a surface portion having surface equipment (110) and a downhole portion having an ESP string (112).

The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for produced fluids (102) to migrate to the surface location (114).

The ESP string (112) may include a motor (118), motor protectors (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface location (114). The motor (118) is cooled by the produced fluids (102) passing over the motor (118) housing. The motor (118) is powered by the power cable (126). The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116).

Motor protectors (120) are located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface location (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity.

The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface location (114). The ESP string (112) outlined in FIG. 1 may be described as a standard ESP string (112), however, the term ESP string (112) may be referring to a standard ESP string (112) or an inverted ESP string (112) without departing from the scope of the disclosure herein.

A packer (142) is disposed around the ESP string (112). Specifically, the packer (142) is located above (i.e., closer to the surface location (114)) the multi-stage centrifugal pump (124). The packer (142) may be any packer (142) known in the art such as a mechanical packer (142). The packer (142) seals the annulus (128) space located between the ESP string (112) and the casing (108). This prevents the produced fluids (102) from migrating past the packer (142) in the annulus (128).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface location (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126). The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Figure 2:
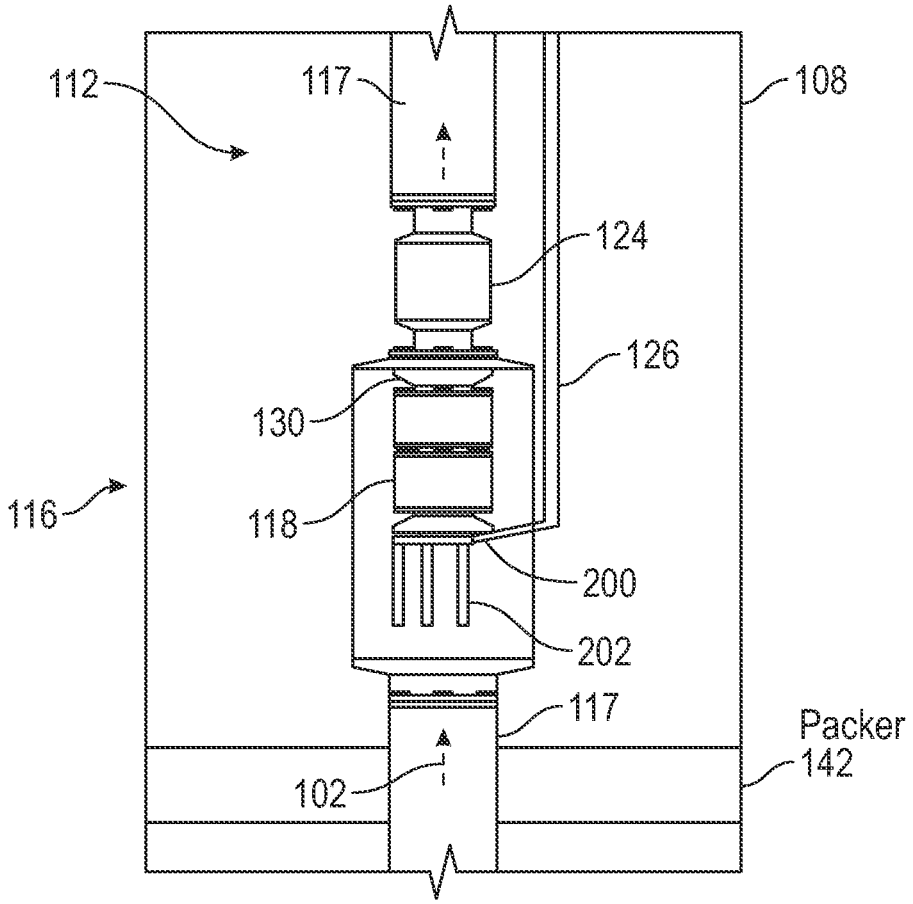
FIG. 2 shows a system in accordance with one or more embodiments.

FIG. 2 shows a system in accordance with one or more embodiments. Many ESP systems (100) require the power cable (126) to include a landing test probe (200) during installation. The probe (200) may be used to explore or examine the equipment downhole such as the motor (118) and pump (124). The probe (200) may be used for measurements downhole such as temperature. The probe (200) may have electrical readings. The probe (200) may be a sensor. The probe (200) may be used for integrity checks on the power cable (126) to determine resistance and continuity. The integrity checks may be accomplished through insulation megger checks with an ohmmeter on the surface. The probe (200) is a basic conductor without electronics. As shown in FIG. 2, the probe (200) may be installed on the end of the power cable (126).

Furthermore, FIG. 2 shows the probe (200) downhole after installation. The probe (200) may have the ability to measure and record any of the equipment downhole. The probe (200) may include at least one lead (202). Specific to the embodiment shown, the probe (200) contains three leads (202). The leads (202) may be electrical wires connected from the power cable (126).

Figure 3:
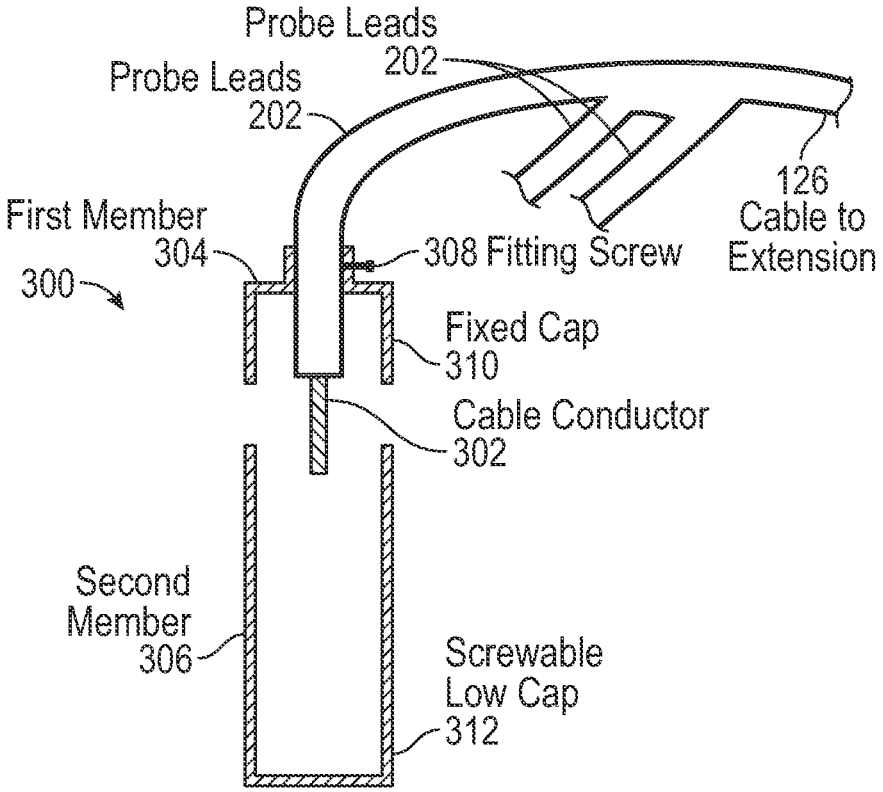
FIG. 3 shows a device in accordance with one or more embodiments.

FIG. 3 shows a device in accordance with one or more embodiments. In one or more embodiments, the probe (200) includes three leads (202). Each lead (202) may include a cable conductor (302) and a probe protector (300). A cable conductor (302) may be exposed wire made of material such as copper, aluminum, or alloy. The cable conductor (302) may be disposed on the distal end of each lead. The cable conductor (302) may be considered contact points of the probe (200). The probe protector (300) may be of any material and shape with the ability to cover the cable conductor (302) onto the probe lead (202). The probe protector (300) may be used to shield and protect the contact points of the probe (200) from conductive or corrosive fluids and open exposure to the environment. The probe protector (300) may be mounted on the cable conductor (302). The probe protector (300) may be removably connected over the cable conductor (302). The probe protector (300) may be installed while the power cable (126) and probe (200) are on surface before installation. The probe protector (300) may be removed from the cable conductor (302) prior to insertion of the power cable (126) into the well.

The probe protector (300) may have a first member (304) and a second member (306). The first member (304) may be secured to the power cable (126). The first member (304) may have a neck portion that is fixed to the power cable (126). The second member (306) may be secured to the first member (304). The first member (304) may contain a fitting screw (308) and a fixed cap (310). The fitting screw (308) may allow for stability of the probe protector (300) to the lead (202). The second member (306) may contain a screwable cap (312). The screwable cap (312) may be a cover that can be screwed onto the first member (304). The screwable cap (312) may allow the second member (306) to be unscrewed from the first member (304). The first member's size is smaller than the second member's size due to the first member's (304) neck portion fitting the lead (202).

The probe protector (300) may include an enclosure between the cable conductor (302) and the probe protector (300). The enclosure may be filled with any stable, low toxicity, chemical reactivity, or thermal conductivity watertight sealant material such as silicone. The material may be capable of repelling water and does not support microbiological growth. The sealant material may include resistance to ultraviolet light and heat. The sealant material may be a protectant against hostile and harsh conditions such as shock and vibration.

Figure 4:
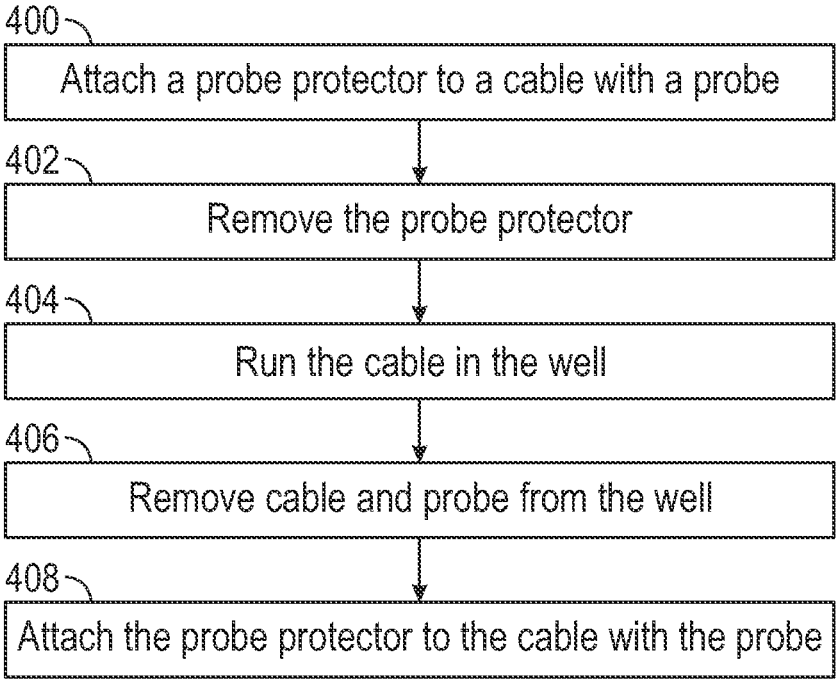
FIG. 4 shows a flowchart in accordance with one or more embodiments.

FIG. 4 shows a flowchart in accordance with one or more embodiments. The flowchart outlines a method for protecting the probe (200) on the power cable (126). The various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, a probe protector (300) is attached to a probe (200) on a power cable (126). The probe protector (300) may cover the cable conductor (302) on each of the leads (202) at the distal end of the probe (200). Each lead (202) may be a wire. In Block 402, the probe protector (300) is removed from the probe (200) on the power cable (126). In Block 404, the power cable (126) is run into the well (116). The power cable (126) may be run to a predetermined depth in the well (116). In Block 406, the power cable (126) with the probe (200) is removed from the well (116). The power cable (126) may be removed from the well (116) when the probe (200) fails. In Block 408, the probe protector (300) is attached to the probe (200). The power cable (126) may be run into the well (116) during ESP installation and landing of any ESP string (112). The probe protector (300) may be attached to the leads (202) on the probe (200) when the probe (200) is not in operation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for a probe protector, the system comprising:

an electrical submersible pump (ESP) landing test probe installed on an end of a cable, wherein the probe comprises at least one lead and a cable conductor disposed on a distal end of each of the at least one lead; and a probe protector mounted on the cable conductor, wherein the probe protector is removably connected over the cable conductor, and wherein the probe protector is removed from the cable conductor prior to insertion of the cable into a well, wherein the probe protector comprises a first member connected to a second member, wherein the first member is directly secured to the cable, and wherein the second member is secured to the first member over the cable conductor.

2. The system of claim 1, wherein the second member is configured to screw to the first member over the cable conductor.

3. The system of claim 2, wherein the probe protector comprises an enclosure between the second member and the cable conductor.

4. The system of claim 3, wherein the enclosure comprises watertight sealant material.

5. The system of claim 2, wherein a first size of the first member and a second size of the second member differ.

6. The system of claim 5, wherein the first size is smaller than the second size.

7. The system of claim 1, wherein the first member comprises a fitting screw.

8. The system of claim 1, wherein the first member comprises a fixed cap.

9. The system of claim 1, wherein the second member comprises a screwable cap.

10. The system of claim 1, wherein the at least one lead is a wire.

11. The system of claim 1, wherein the first member comprises a neck portion fixed directly to the cable, the neck portion fitting the at least one lead.

12. A probe protector method, the method comprising:

attaching the probe protector to a cable, the cable comprising an electrical submersible pump (ESP) test probe, at least one lead, a cable conductor, and the probe protector, wherein the probe protector covers the cable conductor on each of the at least one lead at a distal end of the probe;

securing a second member of the probe protector to a first member of the probe protector over the cable conductor;

securing, using a fitting screw, the first member directly to the cable; and removing the probe protector prior to running the cable to a predetermined depth in a well.

13. The method of claim 12, wherein the at least one lead is a wire.

14. The method of claim 12, wherein method further comprises screwing, using a screwable cap, the second member to the first member.

15. The method of claim 12, wherein a first size of the first member is smaller than a second size of the second member.

16. The method of claim 12, further comprising:

filling an enclosure, disposed between the second member and the cable conductor, with watertight sealant material.

17. The method of claim 12, wherein securing the first member comprises fixing a neck portion of the first member directly to the cable, wherein fixing the neck portion comprises fitting the neck portion to the at least one lead.

* * * * *